US010112429B2

(12) United States Patent
Lazzari et al.

(10) Patent No.: US 10,112,429 B2
(45) Date of Patent: Oct. 30, 2018

(54) METHOD OF FORMING A COLOR LASER IMAGE, AND RESULTING DOCUMENT

(71) Applicants: Jean Pierre Lazzari, Sainte Maxime (FR); Jean Marc Lazzari, Saint Remy l'Honore (FR)

(72) Inventors: Jean Pierre Lazzari, Sainte Maxime (FR); Jean Marc Lazzari, Saint Remy l'Honore (FR)

( * ) Notice: Subject to any disclaimer, the term of this patent is extended or adjusted under 35 U.S.C. 154(b) by 347 days.

(21) Appl. No.: 14/367,013

(22) PCT Filed: Dec. 5, 2012

(86) PCT No.: PCT/FR2012/000501

§ 371 (c)(1),
(2) Date: Jun. 19, 2014

(87) PCT Pub. No.: WO2013/093230

PCT Pub. Date: Jun. 27, 2013

(65) Prior Publication Data

US 2014/0361527 A1 Dec. 11, 2014

(30) Foreign Application Priority Data

Dec. 19, 2011 (FR) ..... 11 03919

(51) Int. Cl.
*B42D 25/41* (2014.01)
*B42D 25/435* (2014.01)
(Continued)

(52) U.S. Cl.
CPC ..... *B42D 15/00* (2013.01); *B41J 2/442* (2013.01); *B41M 3/14* (2013.01); *B41M 5/28* (2013.01); *B41M 5/34* (2013.01); *B42D 25/324* (2014.10); *B42D 25/41* (2014.10); *B42D 25/435* (2014.10); *B42D 2035/20* (2013.01)

(58) Field of Classification Search
CPC ..... B42D 25/41; B42D 25/435
See application file for complete search history.

(56) References Cited

U.S. PATENT DOCUMENTS 5,350,198 A 9/1994 Bernecker
5,364,829 A 11/1994 Kishimoto et al.
(Continued)

FOREIGN PATENT DOCUMENTS

CN 101546138 A 9/2009
CN 102015188 A 4/2011
(Continued)

OTHER PUBLICATIONS

Halftone—Wikipedia https://en.wikipedia.org/wiki/Halftone.*
(Continued)

*Primary Examiner* — Kyle R Grabowski
(74) *Attorney, Agent, or Firm* — MH2 Technology Law Group, LLP

(57) ABSTRACT

The present invention relates to a method of forming color laser images. The latent image made up or color subpixels (2) and of non-colored zones is personalized by a laser beam (8) that acts in the laserable layer (3) situated under the color subpixels (2) and the non-colored zones to cause a final personalized color laser image to appear. The invention is applicable to identity documents.

16 Claims, 2 Drawing Sheets

(51) Int. Cl.

| | |
|---|---|
| ***B42D 15/00*** | (2006.01) |
| ***B41M 3/14*** | (2006.01) |
| ***B41M 5/28*** | (2006.01) |
| ***B41M 5/34*** | (2006.01) |
| ***B41J 2/44*** | (2006.01) |
| ***B42D 25/324*** | (2014.01) |

(56) References Cited

U.S. PATENT DOCUMENTS

| | | | | |
|---|---|---|---|---|
| 6,633,321 | B1 * | 10/2003 | Maurer | B42D 25/41 283/77 |
| 8,076,047 | B2 | 12/2011 | Fukushima et al. | |
| 8,558,137 | B2 | 10/2013 | Yuasa et al. | |
| 9,035,986 | B2 | 5/2015 | Lazzari et al. | |
| 2008/0284157 | A1 * | 11/2008 | Muke | B42D 25/00 283/86 |
| 2009/0315316 | A1 * | 12/2009 | Staub | B42D 25/41 283/72 |

FOREIGN PATENT DOCUMENTS

| | | | |
|---|---|---|---|
| WO | 2011/124774 | A1 | 10/2011 |
| WO | 2011124774 | | 10/2011 |

OTHER PUBLICATIONS

Auth. Officer Blaise Dardel. International Search Report dated Feb. 28, 2013 from International Application No. PCT/FR2012/000501 filed Dec. 5, 2012, pp. 1-4.

Chinese Search Report dated Jul. 1, 2015 in CN Application No. 201280067978.9, 6 pages.

* cited by examiner

METHOD OF FORMING A COLOR LASER IMAGE, AND RESULTING DOCUMENT

CROSS-REFERENCE TO RELATED APPLICATIONS

This application is a U.S. National Stage application of PCT/FR2012/000501 filed 5 Dec. 2012, which claims priority to French Application No. 11/03919 filed 19 Dec. 2011, the entire disclosures of which are hereby incorporated by reference in their entireties.

FIELD OF APPLICATION OF THE INVENTION

The present invention relates to a method of forming color laser images. It finds applications in particular in identity images for identity documents identity cards, credit cards, health insurance cards, passports, drivers licenses, secure entry badges, etc.

STATE OF THE PRIOR ART

Patent WO 2011/124774 A1 describes a method of personalizing embedded latent images for identity documents, including a latent image made up of a matrix of pixels constituted by color subpixels embedded in a transparent protection layer. With the help of a laser beam acting through the transparent protection layer, gray levels are created on the subpixels by covering them with a black non-reflecting surface, thereby creating the gray levels of the final color laser image. This treatment serves to personalize the latent image that is constituted by the color subpixels.

The image as personalized in this way is observed by reflection through the transparent protection layer. The personalized image must be sufficiently reflective to enable it to be observed in ambient light without having recourse to an additional light source.

Patent application No. 11/00578 describes a method of making a highly reflective laser image comprising a latent image made up of color subpixels surrounded by non-colored transparent zones and covered in a transparent protection layer that is sensitive to laser radiation, that is referred to below as the "laserable" layer. A laser beam causes non-reflecting black surfaces to appear in this laserable protection layer, which surfaces cover the surfaces of the color subpixels and subpixels and the non-colored surfaces to a greater or lesser extent for the purpose of imparting the gray levels of a personalized image. The personalized image is seen by reflection on underlying reflective sublayers, in particular white sublayers, or through varnish, in order to increase the reflectivity of the image. Image reflectivity is of fundamental importance since it must enable the eye to act by additive composition to integrate the light beams with the colors of the subpixels and from the non-colored zones, as emitted by back reflection of the incident light.

Although advantageous in some respects, those structures nevertheless put a limit on the quality of the personalized image. The non-reflecting black surfaces that form the gray levels of the personalized image are situated either on the subpixels, or above the subpixels of the latent image, and they form shadow effects that darken the final personalized image.

SUMMARY OF THE INVENTION

An object of the present invention is to remedy the drawbacks of the prior art by improving the quality of the final personalized image. To do this, the invention proposes forming the non-reflecting surfaces that constitute the gray levels of the final personalized image under the latent image constituted by the color subpixels.

More precisely, the invention provides a method of forming personalized color laser images from an assembly comprising a transparent protection layer, a printed latent image constituted by color subpixels and by non-colored surfaces, a laserable layer under the latent image, reflective means, and a laser beam that passes through the protection layer, through the subpixels of the latent image, and the non-colored surfaces and forms the gray levels of a final personalized image in the laserable layer, the assembly being laminated on a medium.

The gray levels that lead to the latent image being personalized in order to form the final image are calculated with the help of software that takes an original image, segments it into subpixels, calculates the corresponding color shades, and determines the gray levels that are to be carbonized in the laserable layer under the color subpixels and the non-colored zones of the latent image in order to obtain the same color shades as those in the original image.

The gray levels of the personalized image are obtained by a degree of blackening that is made proportional to the energy deposited by the laser by means of linearizing software, known to the person skilled in the art, and also by varying the areas of the carbonization.

Furthermore, the energy of the laser beam is adjusted as a function of the colors of the subpixels, and of the non-colored zones through which it passes, since the required laser energy needs to be adjusted depending on the colors of the subpixels and on the transparency of the non-colored zones.

By way of non-limiting example, the laserable materials that form the gray levels of the personalized image by being carbonized under the effect of a laser beam may be constituted by polycarbonates, certain treated polyvinyl chlorides, treated acrylonitrile-butadiene-styrenes, or treated polyethylene terephthalates.

In particular implementations of the invention;

- the medium of the identity document is white in color, with surface doping, so as to be sensitive to the laser radiation for forming the gray levels of the personalized image, with the latent image constituted by color subpixels and by non-colored zones being printed on that surface;
- the color subpixels of the latent image are printed on the surface of the protection layer that is to be laminated on the laserable layer;
- the laserable layer is transparent. It is laminated onto a reflective surface that may advantageously be constituted by the body of the document that is white in color;
- the body of the document is transparent; and
- the protection layer is hot-pressed during lamination in order to form a lens array.

The thickness of the laserable layer or the thickness of the doped portion of the document medium should be as thin as possible, while being compatible with the required gray levels. This thickness may advantageously lie in the range a few micrometers to about one hundred micrometers.

The color subpixels are printed by offset printing, ink-jet printing, or any other technique known to the person skilled in the art. Non-colored zones or non-colored subpixels serve to increase the reflectivity of the final image The color subpixels and the non-colored zones are organized in parallel columns or in small areas that are uniformly distributed. The latent image may be constituted by triplets or quadruplets of color subpixels. The colors of the subpixels are preferably selected from colors that are independent, i.e. mixing any two of them cannot lead to a third subpixel color being formed. These colors include red, green, and blue, or yellow, magenta, and cyan.

In the second fabrication step, referred to as "laminating", the protection layer and the layer of laserable material are bonded hot under pressure, onto the body of the identity document, thereby embedding the matrix of color subpixels and of non-colored zones between the protection layer and the layer of laserable material.

In another variant of the invention, during lamination, the protection layer may be molded to give it specific shapes, such as a lens array, enabling the laser beam at particular angles of incidence to etch under the latent image so as to personalize a plurality of distinct color laser images.

The laser carbonization that causes the gray levels to appear obstructs incident light to a greater or lesser extent and also the reflected light that passes through the color subpixels and the non-colored zones of the latent image, thereby limiting interfering reflections and shadowing effects that might obscure the final personalized image.

The invention also provides a document including a personalized laser image made by performing the above method.

This document comprises a transparent protection sheet, a latent image constituted by an array of color subpixels and of non-colored zones, a layer of laserable material situated under the latent image, said sheet being carbonized in at least in part by laser radiation, and a document medium. The protection sheet, the latent image, the laserable layer, and the medium are suitable for being laminated together.

In particular embodiments

- the laserable layer is obtained by surface doping the white-colored body of the document, the latent image constituted by color subpixels and non-colored zones is printed on the doped surface of the body of the document;
- the subpixels of the latent image are printed on the surface of the protection layer that is to he laminated on the laserable layer;
- the laserable layer is transparent. It is laminated on the reflective surface that may advantageously be constituted by the white-colored body of the document;
- the body of the document is transparent; and
- the protection layer is hot-formed during lamination to give it the form of a lens array enabling the laser to etch a plurality of distinct personalized color laser images on the latent image.

DESCRIPTION OF THE FIGURES

The invention appears better from the following description given by way of non-limiting explanation. The description refers to the accompanying drawings, in which.

DETAILED DESCRIPTION

Figure 1:
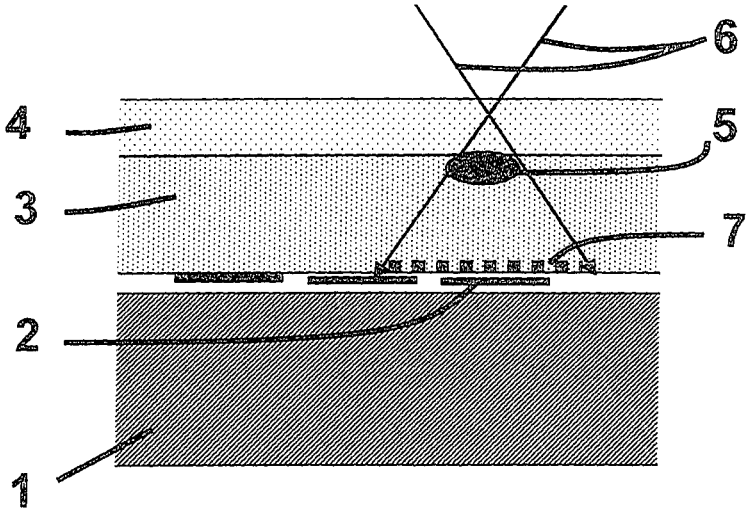
FIG. 1 is a section view of a prior art identity document including a color laser image.

FIG. 1 is a section view of a prior art identity document including a color laser image. The transparent protection layer (4), the laserable layer (3), and the matrix of subpixels are laminated on the body of the identity document (1). The black surface (5) produced by carbonization by means of the laser beam is situated vertically in register with the color subpixel (2) of the latent image. If incident ambient light rays (6) are not accurately perpendicular to the plane of the document, then the shadow cast by the black surface (5) on the color subpixels (2) overflows considerably from the area of the subpixel creating a shadow zone (7) that darkens the personalized image.

Figure 2:
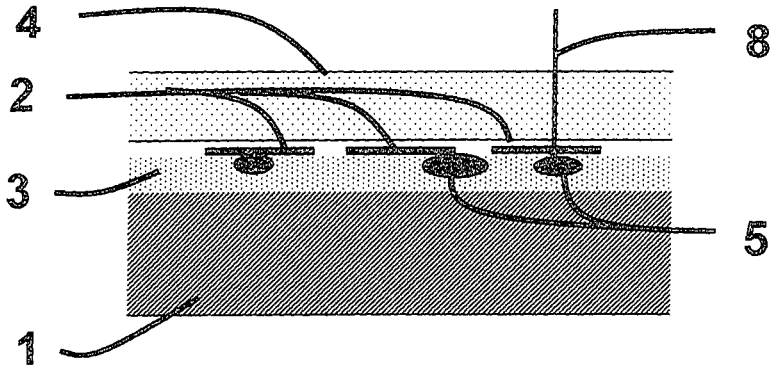
FIG. 2 is a section view of a first document of the invention.

FIG. 2 is a section of a first embodiment of the invention. The body (1) of the identity document is white. It is doped on the surface so as to create a laserable layer (3). The latent image comprising the color subpixels (2) and the non-colored zones is printed on this layer (3). Alternatively, it may be printed on the transparent protection layer (4). The protection layer (4) is laminated onto the assembly. The laser beam (8) forms the gray levels (5) of the final personalized image in the laserable layer (3). No shadow zone appears in the invention.

Figure 3:
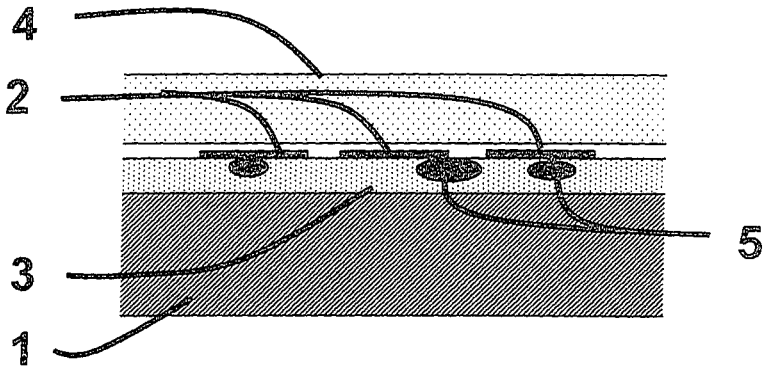
FIG. 3 is a section view of a second embodiment of the invention.

FIG. 3 is a section of a second embodiment of the invention. A layer of laserable material (3) is laminated on the card body (1). The color subpixels (2) are printed on this laserable layer (3) together with non-colored zones, the assembly constituting the latent Image. Alternatively, the color subpixels (2) may be printed on the protection layer. The protection layer (4) is then laminated on the assembly.

Figure 4:
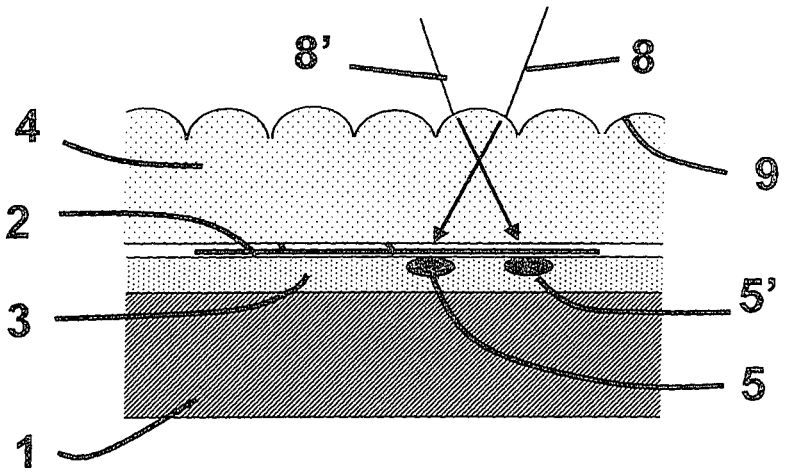
FIG. 4 is a section view of a third embodiment of the invention.

FIG. 4 is a section of a third embodiment of the invention. The laserable layer (3) is obtained on the card body (1) by surface doping the card body (1). In a variant, this laserable layer (3) is laminated on the card body (1). The latent image (2) including the color subpixels and the non-colored zones is printed on the laserable layer (3). Alternatively, the latent image may be printed on the protection layer (4). The protection layer (4) is laminated on the preceding assembly. During lamination, its top surface seen from beside the observer is hot-pressed so as to form a lens array (9). Since the laser rays (8) and (8') have a certain angle of incidence relative to the plane of the document, they act by carbonization in the laserable layer (3) to form two distinct personalized images (5) and (5') under the color subpixels (2) of the latent image. These two color laser images are viewed separately by back reflection of the incident light. In an alternative, three personalized laser images are made.

The invention claimed is:

1. A method of forming personalized color laser images from an assembly comprising:

a transparent protection layer, a printed latent image comprising color subpixels and non-colored surfaces that are organized in small areas that are uniformly distributed such that the printed latent image appears without any discernable image prior to application of a laser beam, a laserable layer under the printed latent image, and reflective means, the method comprising passing the laser beam through the transparent protection layer, through the color subpixels of the printed latent image, and through the non-colored surfaces of the printed latent image to form gray levels in the laserable layer that cause the printed latent image to appear as a personalized color laser image, wherein the transparent protection layer is laminated on the assembly.

2. A method of forming personalized color laser images according to claim 1, wherein the reflective means comprises a body, and wherein the laserable layer is obtained by surface doping the body.

3. A method of forming personalized color laser images according to claim 1, wherein the reflective means comprises a body, and wherein the laserable layer is laminated on the body.

4. A method of forming personalized color laser images according to claim 1, wherein the printed latent image is printed on a surface of the laserable layer.

5. A method of forming personalized color laser images according to claim 1, wherein the top face of the transparent protection layer is hot-pressed to form a lens array enabling a plurality of distinct personalized color laser images to be formed.

6. A method of forming personalized color laser images according to claim 1, the method further comprising:

calculating, by a computer and software, the gray levels that are formed, wherein the calculating comprises:

segmenting an original image into subpixels;

calculating corresponding color shades for the subpixels; and determining the gray levels to form in the laserable layer in order to cause the printed latent image to appear with the same color shades as the color shades the original image.

7. A method of forming personalized color laser images according to claim 1, wherein passing the laser beam through the transparent protection layer, through the color subpixels of the printed latent image, and through the non-colored surfaces of the printed latent image to form gray levels comprises:

forming the gray levels by varying the energy deposited by the laser to control a degree of blackening in proportion to the energy deposited by the laser and by varying the areas of carbonization.

8. A method of forming personalized color laser images according to claim 1, the method further comprising:

adjusting the energy of the laser beam as a function of the colors of the subpixels or of the non-colored surfaces through which the laser beam passes.

9. A method of forming personalized color laser images according to claim 1, wherein the laserable layer comprises at least one of: a polycarbonate, a treated polyvinyl chloride, a treated acrylonitrile-butadiene-styrene, and a treated polyethylene terephthalate.

10. A method of forming personalized color laser images according to claim 1, wherein the color subpixels of the printed latent image are printed on a surface of the transparent protection layer that faces the laserable layer.

11. A method of forming personalized color laser images according to claim 1, wherein the color subpixels are printed by offset printing or by ink-jet printing.

12. A document including a personalized color laser image, the document comprising:

a transparent protection sheet, a latent image comprising color subpixels and non-colored surfaces that are organized in small areas that are uniformly distributed such that the printed latent image appears without any discernable image prior to application of a laser beam, a layer of laserable material situated under the latent image, wherein said layer of laserable material is carbonizable at least in part by laser radiation to form gray levels in the layer of laserable material that cause the printed latent image to appear as the personalized color laser image, and a document medium situated under the layer of laserable material, wherein the transparent protection sheet and the layer of laserable material are laminated together.

13. A document according to claim 12, wherein the transparent protection sheet includes a lens array on its surface.

14. A document according to claim 12, wherein the document medium is white.

15. A document according to claim 12, wherein the document medium is transparent.

16. A document according to claim 12, wherein the thickness of the layer of laserable material lies in the range of about three micrometers to about one hundred micrometers.

* * * * *